US009496619B2

(12) United States Patent
Shcherbatko et al.

(10) Patent No.: US 9,496,619 B2
(45) Date of Patent: Nov. 15, 2016

(54) LEAKY-WAVE ANTENNA FOR HEARING DEVICE

(71) Applicant: Samsung Electronics Co., Ltd., Suwon-si (KR)

(72) Inventors: Igor Shcherbatko, Hwaseong-si (KR); Dong Wook Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 267 days.

(21) Appl. No.: 14/211,525

(22) Filed: Mar. 14, 2014

(65) Prior Publication Data

US 2015/0117687 A1 Apr. 30, 2015

(30) Foreign Application Priority Data

Oct. 25, 2013 (KR) ..... 10-2013-0128050

(51) Int. Cl.

| | |
|---|---|
| ***H01Q 13/20*** | (2006.01) |
| ***H04R 25/00*** | (2006.01) |
| ***H01Q 1/27*** | (2006.01) |
| ***H01Q 1/44*** | (2006.01) |
| ***H01Q 1/46*** | (2006.01) |

(52) U.S. Cl.

CPC ..... *H01Q 13/203* (2013.01); *H01Q 1/273* (2013.01); *H01Q 1/44* (2013.01); *H01Q 1/46* (2013.01); *H04R 25/554* (2013.01); *H04R 2225/51* (2013.01)

(58) Field of Classification Search

CPC ..... H04R 25/30; H04R 25/55; H04R 25/60; H04R 25/65; H04R 25/554; H04R 25/556; H04R 25/658; H04R 2225/021; H04R 2225/49; H04R 2225/51; H04R 2225/55; H04R 2225/63; H04R 1/105; H04R 1/1066

See application file for complete search history.

(56) References Cited

U.S. PATENT DOCUMENTS

| | | | | |
|---|---|---|---|---|
| 9,237,404 | B2 * | 1/2016 | Ozden | H04R 25/554 |
| 2004/0204198 | A1 * | 10/2004 | Choi | H01Q 1/243 455/575.1 |
| 2005/0094840 | A1 * | 5/2005 | Harano | H01Q 1/44 381/381 |
| 2005/0244024 | A1 * | 11/2005 | Fischer | H04R 25/554 381/331 |
| 2008/0122711 | A1 * | 5/2008 | Kimura | H01Q 1/273 343/745 |
| 2008/0273735 | A1 * | 11/2008 | Burson | H04R 1/083 381/363 |
| 2009/0196444 | A1 * | 8/2009 | Solum | H01Q 1/273 381/315 |
| 2010/0321269 | A1 * | 12/2010 | Ishibana | H01Q 1/273 343/834 |
| 2011/0022121 | A1 * | 1/2011 | Meskins | A61N 1/37229 607/57 |
| 2014/0177863 | A1 * | 6/2014 | Parkins | H01Q 7/08 381/74 |
| 2014/0185813 | A1 * | 7/2014 | Ozden | H04R 25/552 381/23.1 |
| 2014/0314264 | A1 * | 10/2014 | Meskens | A61N 1/08 381/330 |
| 2015/0078599 | A1 * | 3/2015 | Sundberg | H04R 25/554 381/315 |
| 2015/0146900 | A1 * | 5/2015 | Vonlanthen | H01Q 1/273 381/322 |
| 2015/0164588 | A1 * | 6/2015 | Rossetto | A61B 18/18 606/33 |

FOREIGN PATENT DOCUMENTS

EP 2 458 674 A2 5/2012

* cited by examiner

*Primary Examiner* — Matthew Eason
(74) *Attorney, Agent, or Firm* — NSIP Law

(57) ABSTRACT

A leaky-wave antenna for a hearing device, the leaky-wave antenna including a coaxial radiator configured to receive audio signals from an external device and to indicate conductivity, and a grounding area provided in the coaxial radiator, wherein the leaky-wave antenna is connected to a housing of the hearing device.

24 Claims, 9 Drawing Sheets

LEAKY-WAVE ANTENNA FOR HEARING DEVICE

RELATED APPLICATIONS

This application claims the benefit under 35 USC 119(a) of Korean Patent Application No. 10-2013-0128050, filed on Oct. 25, 2013, in the Korean Intellectual Property Office, the entire disclosure of which is incorporated herein by reference for all purposes.

BACKGROUND

1. Field

The following description relates to a leaky-wave antenna built in a hearing device.

2. Description of Related Art

A hearing device is a device providing audio signals to a user. The hearing device includes a hearing aid, audio devices, and the like. The hearing aid amplifies a sound generating around a user who is wearing the hearing aid and helps the user clearly hear the sound. The hearing aid is small enough to be worn on an external ear of the user. Electronic parts, metallic parts, and plastic parts may be included in a housing of the hearing aid. When the foregoing parts are built in such a small housing along with an antenna for performing wireless communication, various limitations may arise. Hearing aids include the antenna for wireless communication in the housing along with a battery, electronic parts, and other components.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, there is provided a leaky-wave antenna for a hearing device, the leaky-wave antenna including a coaxial radiator configured to receive audio signals from an external device and to indicate conductivity, and a grounding area provided in the coaxial radiator, wherein the leaky-wave antenna is connected to a housing of the hearing device.

The coaxial radiator may be helical.

The coaxial radiator may include a helical slit configured to propagate electromagnetic (EM) waves.

The coaxial radiator may include a plurality of conductive tubes.

The plurality of conductive tubes may have varying diameters.

The leaky-wave antenna may include two wires separate from each other and disposed in the grounding area, wherein the wires are configured to route the audio signals.

A wire may be disposed in the grounding area, wherein the wire is configured to route the audio signals.

The leaky-wave antenna may include a sound induction channel disposed in the grounding area, wherein the sound induction channel is configured to route audio signals generated from a loud speaker built in the hearing device.

The audio signals may be generated in accordance with a ultra wideband (UWB) standard.

The loud speaker may be configured to generate acoustic audio signals corresponding to the audio signals received through the coaxial radiator.

The grounding area may be a conductive cylindrical shell.

The plurality of conductive tubes may have varying lengths.

In another general aspect, there is provided a hearing device including a housing, and a leaky-wave antenna connected to the housing, wherein the leaky-wave antenna includes a coaxial radiator configured to receive audio signals from an outside of the hearing device and to indicate conductivity, and a grounding area provided in the coaxial radiator.

The coaxial radiator may be helical.

The hearing device may include a helical slit to propagate electromagnetic (EM) waves.

The coaxial radiator may include a plurality of conductive tubes.

The plurality of conductive tubes may have varying diameters.

The audio signals may be generated in accordance with an ultra wideband (UWB) standard.

In another general aspect, there is provided a leaky-wave antenna for a hearing device including a coaxial radiator configured to receive audio signals from an external device, and a conductive core disposed in the coaxial radiator, wherein the conductive core is configured to provide grounding and to route the audio signals.

The conductive core may include a conductive cylindrical shell, two wires disposed in a dielectric within the cylindrical shell.

The wires may be configured to route the audio signals.

A first wire may be configured to route the audio signals and a second wire may be configured to provide grounding.

The hearing device may include a loud speaker configured to generate acoustic audio signals corresponding to the audio signals, wherein the conductive core comprises a sound induction channel configured to route the generated audio signals.

The coaxial radiator may be disposed in a protective dielectric.

Other features and aspects will be apparent from the following detailed description, the drawings, and the claims.

Figure 1:
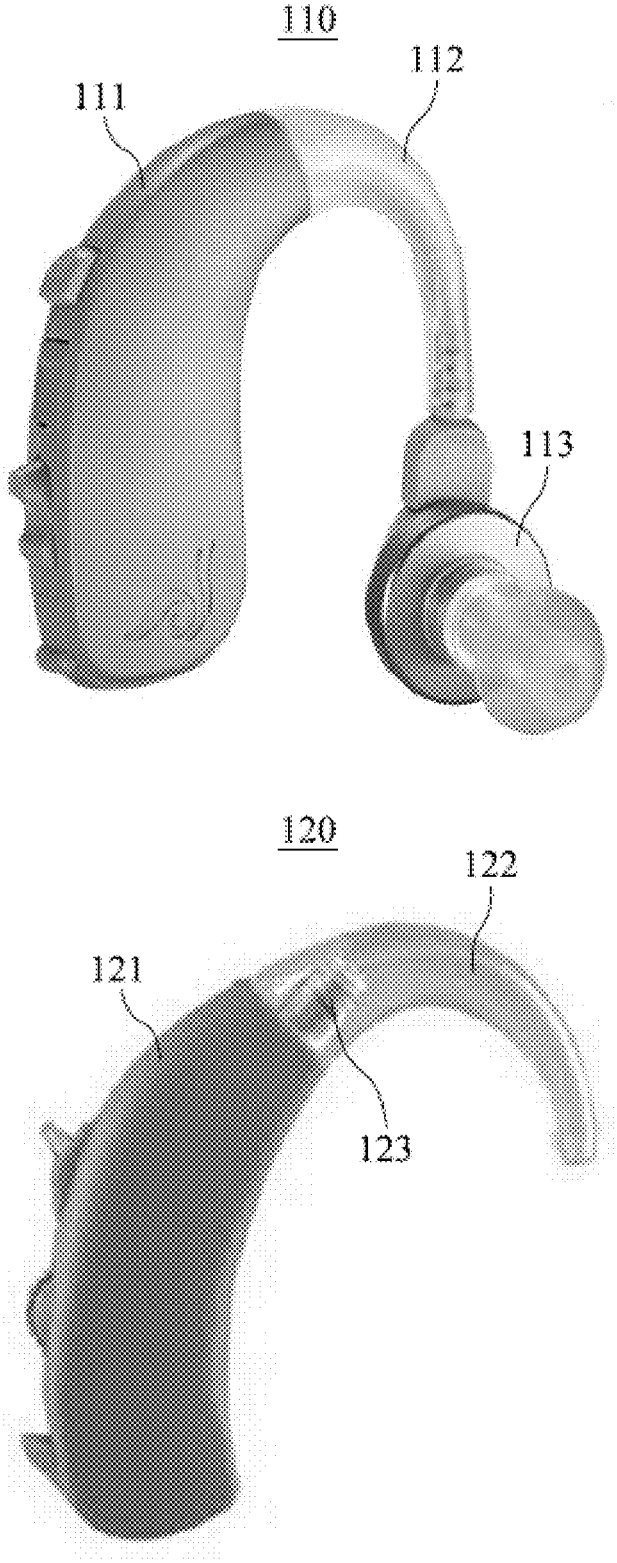
FIG. 1 is a diagram illustrating an example of a hearing device.

Throughout the drawings and the detailed description, unless otherwise described, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein.

However, various changes, modifications, and equivalents of the systems, apparatuses and/or methods described herein will be apparent to one of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

FIG. 1 is a diagram illustrating an example of a hearing device. Referring to FIG. 1, a hearing device includes a hearing device 110 that electrically routes audio signals and a hearing device 120 that acoustically routes audio signals.

The hearing device disclosed herein may include all types of device that is detachably fixed to or in close contact with an ear of a user to provide the user with audio signals based on a sound generated outside the ear. The hearing device may include a hearing aid that amplifies audio signals, thereby helping the user perceive the amplified audio signals. The hearing device may include or be included in a system supporting a hearing aid function. Such a system may include, but is not limited to, a mobile device, a cellular phone, a smart phone, a wearable smart device (such as, for example, a ring, a watch, a pair of glasses, a bracelet, an ankle bracket, a belt, a necklace, an earring, a headband, a helmet, a device embedded in the cloths or the like), a personal computer (PC), a tablet personal computer (tablet), a phablet, a personal digital assistant (PDA), a digital camera, a portable game console, an MP3 player, a portable/personal multimedia player (PMP), a handheld e-book, an ultra mobile personal computer (UMPC), a portable lab-top PC, a global positioning system (GPS) navigation, and devices such as a television (TV), a high definition television (HDTV), an optical disc player, a DVD player, a Blue-ray player, a setup box, any other consumer electronics/information technology (CE/IT) device, a plug-in accessory of a module for a hearing aid having a sound or broadcasting relay function, or a chip having a hearing aid function.

The hearing device may include a monaural device that generates audio signals for one ear and a binaural device that generates audio signals for both ears.

According to a non-exhaustive example, the hearing device may be a behind-the-ear hearing aid. The hearing device may include a housing, such as a case, an ear mold or dome, and a connector connecting the housing with the ear mold. The housing is designed to be disposed behind a pinna and the connector may hang down to a front of the ear from the housing. The hearing device 110 may route audio signals to the ear of the user electrically or acoustically. When the audio signals are electrically routed, a loud speaker may be disposed in the ear mold or an open-fit dome. When the audio signals are acoustically routed, a plastic tube may be used to route the audio signals from the loud speaker of the housing into an ear channel.

The hearing device 110 that electrically routes audio signals may include a housing 111, a leaky-wave antenna 112, and a loud speaker 113. The housing 111 may be an overall case of the hearing device 110. The housing 111 may include a battery, a switch, a microphone, and various control parts and electronic parts. However, in the example shown in FIG. 1, the housing 111 does not include the leaky-wave antenna 112.

The leaky-wave antenna 112 is built in the hearing device 110 and adapted to perform wireless communication with an external device. The leaky-wave antenna 112 may include a channel for electrically or acoustically routing audio signals received through the wireless communication. The leaky-wave antenna 112 may include an external shell-like part and a conductive core part. The external shell-like part may be a coaxial radiator that receives the audio signals from the external device and indicates conductivity. The conductive core part may be a grounding area in the form of a conductive cylindrical shell included in the coaxial radiator. The grounding area may include an electrical wire routing electrical audio signals to the loud speaker 113 or a sound induction channel inducing the audio signals to the ear of the user. The sound induction channel may be connected to a tube.

The wireless communication may be performed in accordance with an ultra wideband (UWB) communication standard. The audio signals received through the wireless communication may be signals generated according to the UWB communication standard. The UWB communication may belong to a wireless body area network (WBAN). A wireless communication device complying with the UWB standard may operate at about 3 to 10 gigahertz (GHz). The UWB standard suggested here is only a non-exhaustive example, and other wireless communication methods are considered to be well within the scope of the present disclosure.

The loud speaker 113 may convert the electrical audio signals routed from the housing 111 into acoustic audio signals, and route the acoustic audio signals to the ear of the user wearing the hearing device 110. For example, the loud speaker 113 may be a receiver.

The hearing device 120 that acoustically routes the audio signals may include a housing 121, a leaky-wave antenna 122, and a loud speaker 123.

The housing 121 may be an overall case of the hearing device 120. The housing 121 may include a battery, a switch, a microphone, and various control parts and electronic parts. However, in the example shown in FIG. 1, the housing 121 does not include the leaky-wave antenna 122.

The leaky-wave antenna 112 may include a coaxial radiator that receives audio signals from an external device and indicates conductivity, and a grounding area in the form of a conductive cylindrical shell included in the coaxial radiator. The leaky-wave antenna 122 may be connected to the housing 121 built in the hearing device 120.

The loud speaker 123 may convert the electrical audio signals received through the leaky-wave antenna 122 into acoustic audio signals. The loud speaker 123 may route the acoustic audio signals to the ear of the user wearing the hearing device 120. The audio signals output to the loud speaker 123 may be routed to the ear of the user wearing the hearing device 120 through the leaky-wave antenna 122. For example, the loud speaker 123 may be a receiver.

Figure 2:
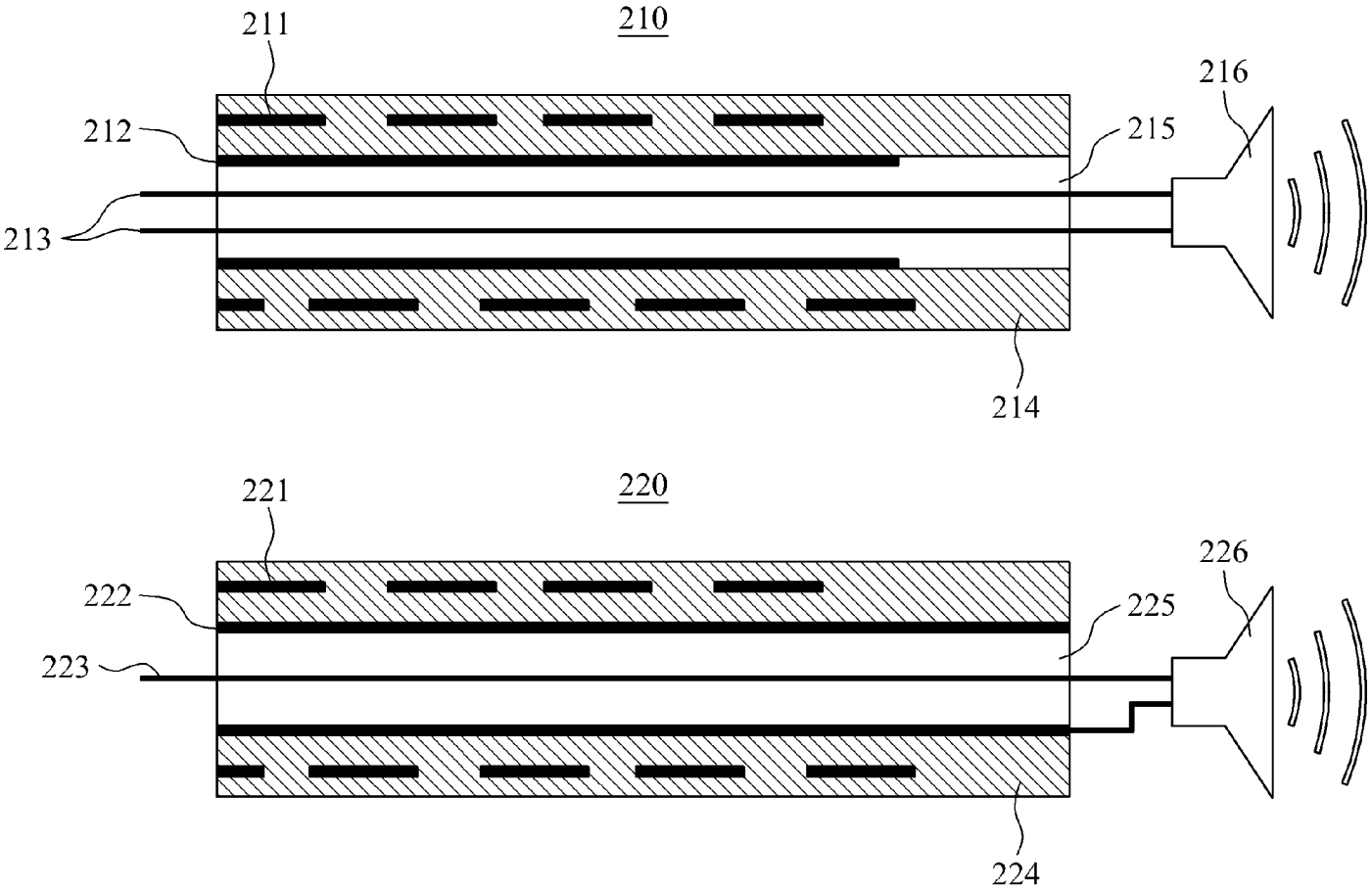
FIG. 2 is a diagram illustrating examples of electrical routing of an audio signal.

FIG. 2 is a diagram illustrating an example of electrical routing of an audio signal. FIG. 2 shows a leaky-wave antenna 210 adapted to electrically route audio signals. The leaky-wave antenna 210 may include a coaxial radiator 211, a grounding area 212, two wires 213, a protective dielectric 214, and a dielectric 215. According to the example shown in FIG. 2, in the leaky-wave antenna 210 that electrically routes audio signals, a radio frequency (RF), and an audio channel are electrically separated from each other. In FIG. 2, the leaky-wave antenna 210 has been shown to include a loud speaker 216 for ease of explanation, it is understood that the leaky-wave antenna 210 may not include the loud speaker 216.

The coaxial radiator 211 may indicate conductivity and receive audio signals from an external device. To receive the audio signals, the coaxial radiator 211 may include a helical slit for propagating electromagnetic (EM) waves. The helical slit may be a periodic slit and may be analyzed by a finite-difference time-domain (FDTD) method with respect to a sub-GHz frequency band. Therefore, various types of the leaky-wave antenna may be designed to have different operation frequency bands.

The grounding area 212 may be included in the coaxial radiator 211. The grounding area 212 may be a conductive cylindrical shell. The grounding area 212 may include the two wires 213 and the dielectric 215.

The two wires 213 may route the audio signals to the loud speaker 216. The two wires 213 may be separated from the grounding area 212, and in another example, the two wires 213 may be included in the grounding area 212. One of the two wires 213 may perform grounding while another may route audio signals with reference to the wire performing the grounding function. Since the grounding is performed separately from the housing of the hearing device, the grounding area 212 may be designed more freely.

The protective dielectric 214 may include the coaxial radiator 211, and the protective dielectric 214 may protect the coaxial radiator 211 from corrosion and an external environment.

The dielectric 215 may include the two wires 213. The dielectric 215 may secure the two wires 213 so that the two wires 213 are separated from the grounding area 212. In addition, the dielectric 215 may prevent the two wires 213 from corrosion and the external environment.

The loud speaker 216 may receive audio signals from the housing of the hearing device through the two wires 213. The loud speaker 216 may route the received audio signals to the ear of the user.

FIG. 2 also shows a leaky-wave antenna 220 adapted to electrically route audio signals.

The leaky-wave antenna 220 may include a coaxial radiator 221, a grounding area 222, a wire 223, a protective dielectric 224, and a dielectric 225. In FIG. 2, the leaky-wave antenna 220 has been shown to include a loud speaker 226 for ease of explanation, it is understood that the leaky-wave antenna 210 may not include the loud speaker 226.

The coaxial radiator 221 may indicate conductivity and receive audio signals from an external device. To receive the audio signals, the coaxial radiator 221 may include a helical slit for propagating EM waves.

The grounding area 222 may be included in the coaxial radiator 221. The grounding area 222 may be a conductive cylindrical shell. The grounding area 222 may include the wire 223 and the dielectric 225.

The wire 223 may route the audio signals to the loud speaker 226. The wire 223 may be separated from the grounding area 222 and in another example, the wire 223 may be included in the grounding area 222. The wire 223 may route the audio signals with reference to the grounding area 222. Thus, since a dedicated grounding area is unnecessary, the structure may be simplified.

The protective dielectric 224 may include the coaxial radiator 221, and the protective dielectric 224 may prevent the coaxial radiator 221 from corrosion and the external environment.

The dielectric 225 may include the wire 223. The dielectric 225 may secure the wire 223 such that the wire 223 is separated from the grounding area 222. In addition, the dielectric 225 may prevent the wire 223 from corrosion and the external environment.

The loud speaker 226 may receive audio signals from the housing of the hearing device through the wire 223 and the grounding area 222. The loud speaker 226 may route the received audio signals to the ear of the user.

Figure 3:
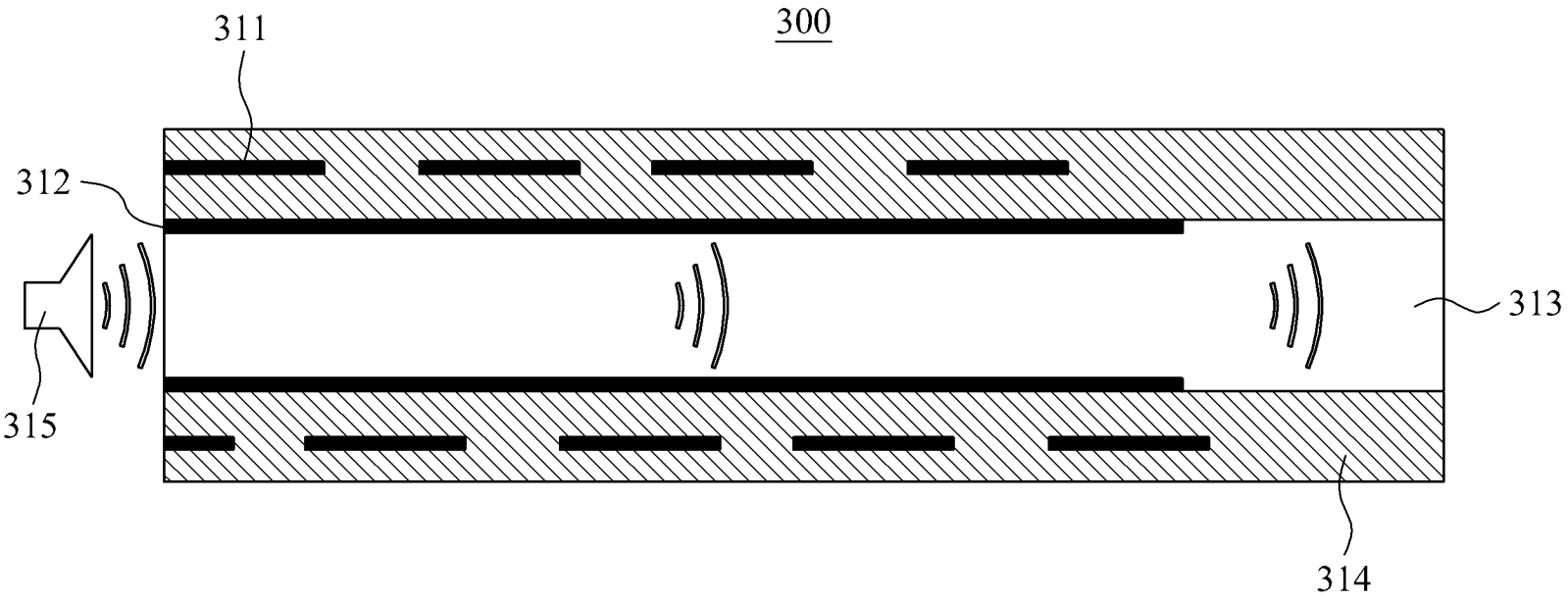
FIG. 3 is a diagram illustrating an example of acoustic routing of an audio signal.

FIG. 3 is a diagram illustrating an example of acoustic routing of an audio signal. FIG. 3 shows an example of a leaky-wave antenna 300 adapted to acoustically route audio signals. The leaky-wave antenna 300 may include a coaxial radiator 311, a grounding area 312, a sound induction channel 313, and a protective dielectric 314. In FIG. 3, the leaky-wave antenna 300 has been shown to include a loud speaker 315 for ease of explanation, it is understood that the leaky-wave antenna 300 may not include the loud speaker 315.

The coaxial radiator 311 may indicate conductivity and receive audio signals from an external device. To receive the audio signals, the coaxial radiator 311 may include a helical slit for propagating EM waves.

The grounding area 312 may be included in the coaxial radiator 311. The grounding area 312 may be a conductive cylindrical shell. The grounding area 312 may include the sound induction channel 313. The grounding area 312 may function as a sound induction tube.

The sound induction channel 313 may be a vacant space in which the acoustic audio signals generated by the loud speaker 315 may be propagated and routed to the user. The acoustic audio signals may be output to the outside of the hearing device through the sound induction channel 313.

The protective dielectric 314 may include the coaxial radiator 311. Therefore, the protective dielectric 314 may protect the coaxial radiator 311 from corrosion and the external environment. According to a non-exhaustive example, the protective dielectric 314 may be a dielectric tube that routes acoustic audio signals.

The loud speaker 315 may be built in the hearing device, and may generate acoustic audio signals corresponding to the audio signals received through the coaxial radiator 311.

Figure 4A:
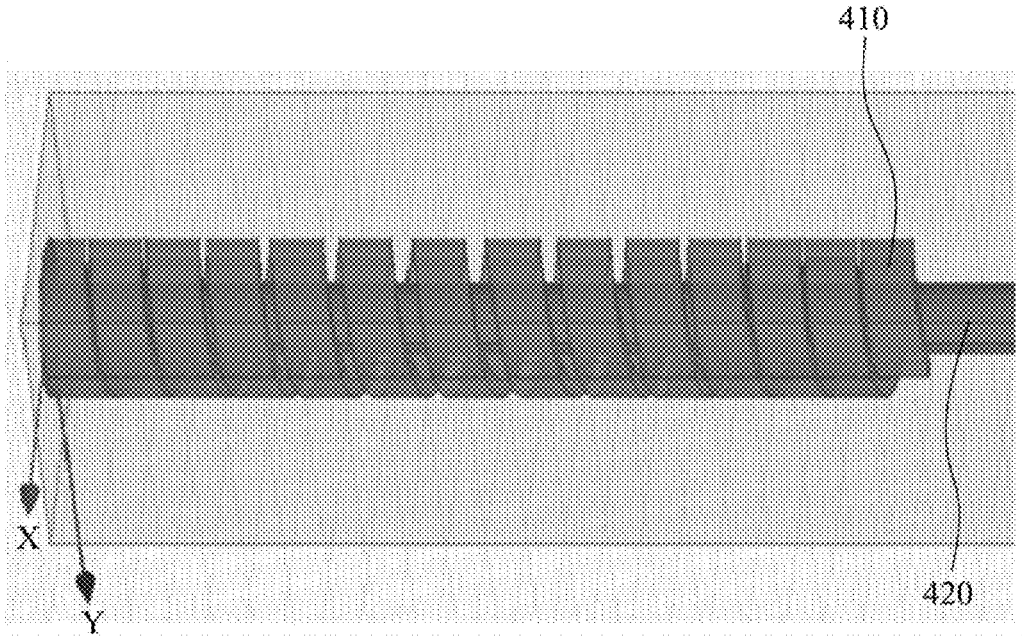
FIGS. 4A and 4B are diagrams illustrating examples of various types of leaky-wave antenna.
Figure 4B:
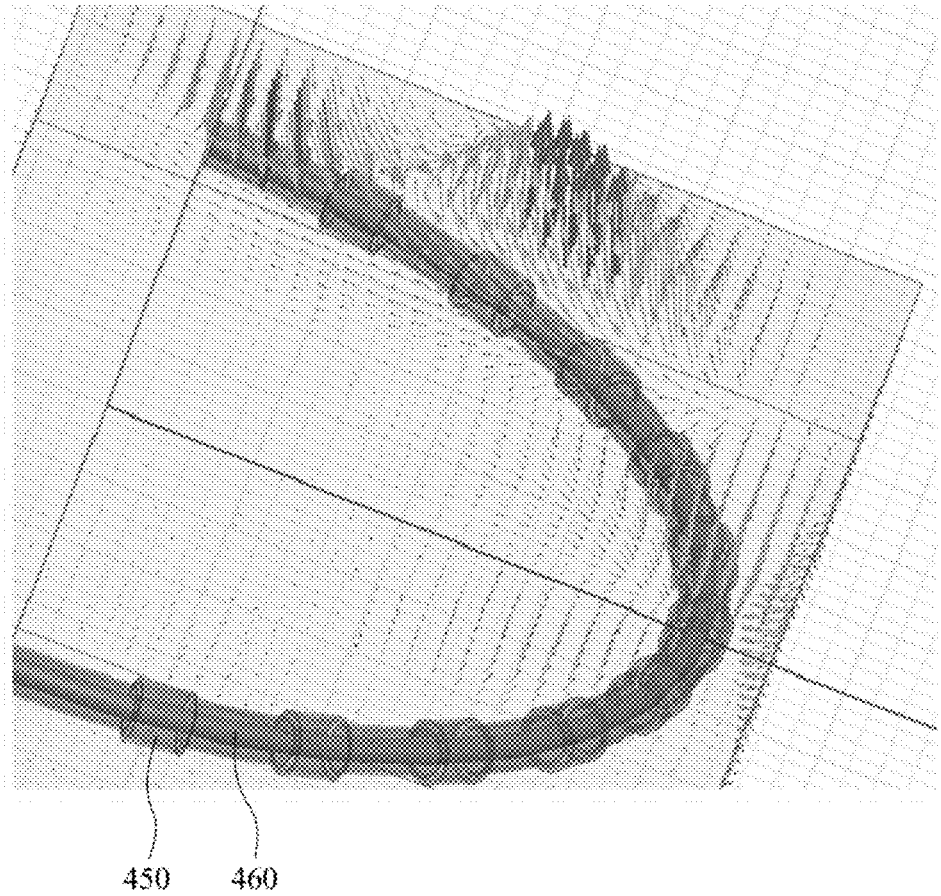

FIGS. 4A and 4B are diagrams illustrating examples of various types of a leaky-wave antenna.

Referring to FIGS. 4A and 4B, the leaky-wave antenna may include 1) a leaky-wave antenna provided with a helical coaxial radiator 410 and 2) a leaky-wave antenna provided with a coaxial radiator 450 disposed in a periodically alternating manner.

FIG. 4A shows an example of the leaky-wave antenna provided with the helical coaxial radiator 410. In the example shown in FIG. 4A, the coaxial radiator 410 may be provided in a helical shape, and in this case, the leaky-wave antenna may include the helical coaxial radiator 410 and a grounding area 420.

The helical coaxial radiator 410 may surround the grounding area 420 in a helical manner. According to a non-exhaustive example, the helical coaxial radiator 410 may be linearly formed. In addition, the helical coaxial radiator 410 may include a helical slit. The helical slit in an external coaxial shell may make EM wave propagation inside the coaxial radiator 410 such as a disturbed coaxial line similar to propagation inside one-dimensional (1D) photonic crystal. Thus, the influence of the external environment of the leaky-wave antenna on the propagation of the EM wave may be weaker than the influence of an internal geometry of the leaky-wave antenna. The leaky-wave antenna may provide a radiated field concentrated on an antenna feeding point, gradually decreasing along the leaky-wave antenna. The radiated field may have a maximum value at the antenna feeding point.

The grounding area 420 may be a conductive cylindrical shell. According to a non-exhaustive example, the grounding area 420 may be linearly formed.

FIG. 4B shows an example of a leaky-wave antenna provided with the periodically alternating coaxial radiator 450, and in this case, the leaky-wave antenna may include the periodically alternating coaxial radiator 450 and a grounding area 460.

The periodically alternating coaxial radiator 450 may include a plurality of conductive tubes. According to a non-exhaustive example, the plurality of conductive tubes may have varying diameters. Therefore, the periodically alternating coaxial radiator 450 may show a wider bandwidth than a resonant type. In addition, due to the plurality of conductive tubes, propagated EM waves, for example UWB signals, flowing through the leaky-wave antenna from a feeding point, for example a coaxial input, may interrupt an induced surface current and leak to the outside of the leaky-wave antenna. Intervals of the plurality of conductive tubes may be uniform or variable. The periodically alternated coaxial radiator 450 may be provided in an arc shape. The grounding area 420 may be a conductive cylindrical shell. According to an example, the grounding area 420 may be linearly formed.

Arrows shown around the leaky-wave antenna in the drawing indicate distribution of an electrical field (E-field) generated around the leaky-wave antenna.

FIGS. 5A, 5B, 5C, and 5D are diagrams illustrating various characteristics of an arc-shape leaky-wave antenna.

Figure 5A:
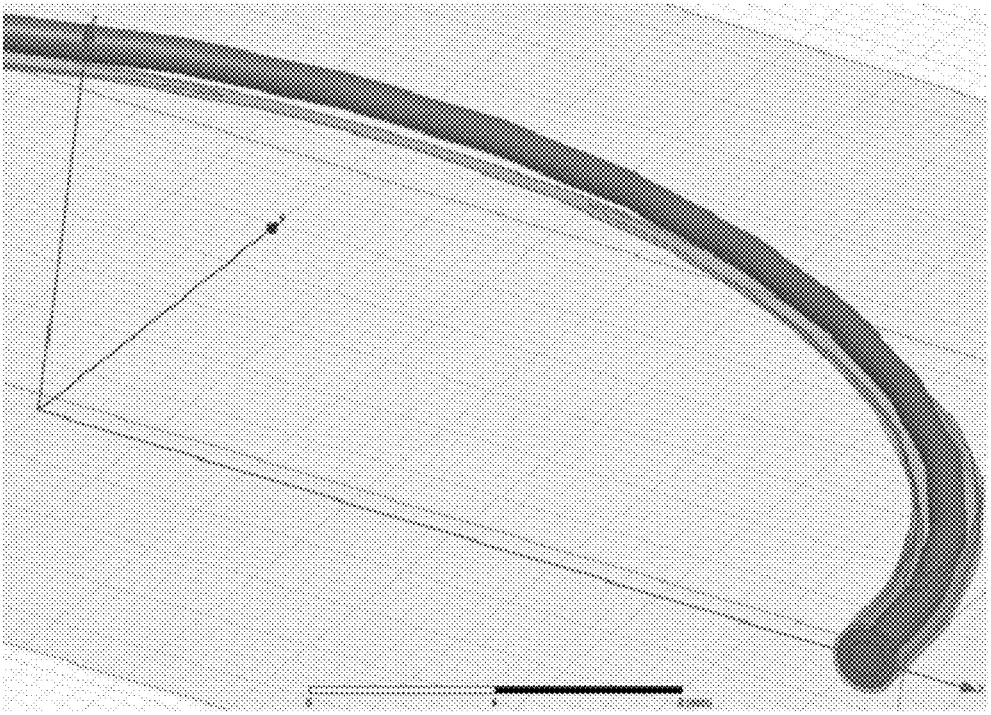
FIGS. 5A, 5B, 5C, and 5D are diagrams illustrating examples of various characteristics of an arc-shape leaky-wave antenna.
Figure 5B:
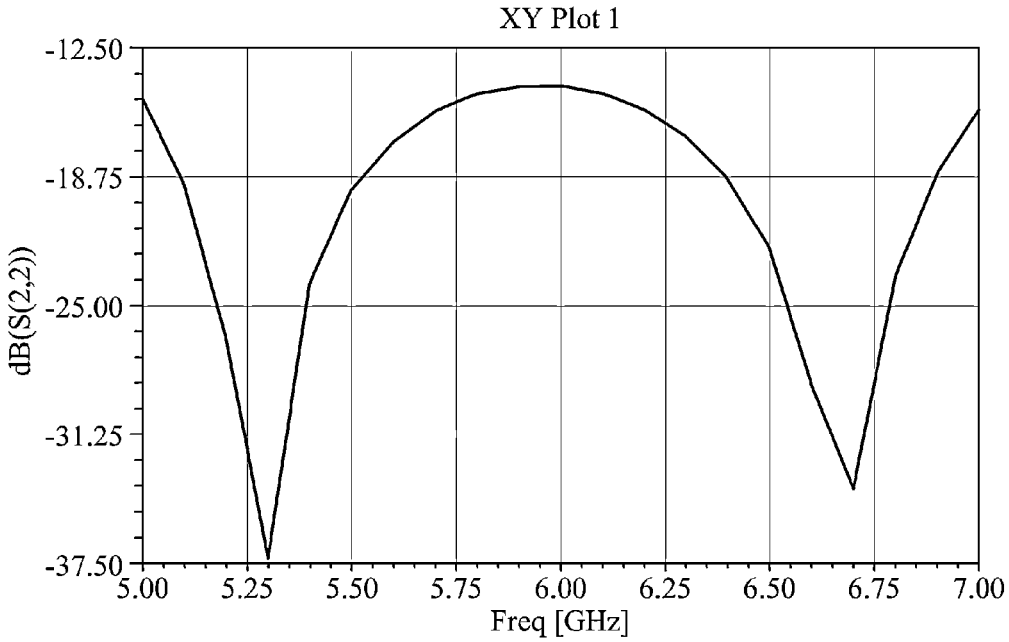
Figure 5C:
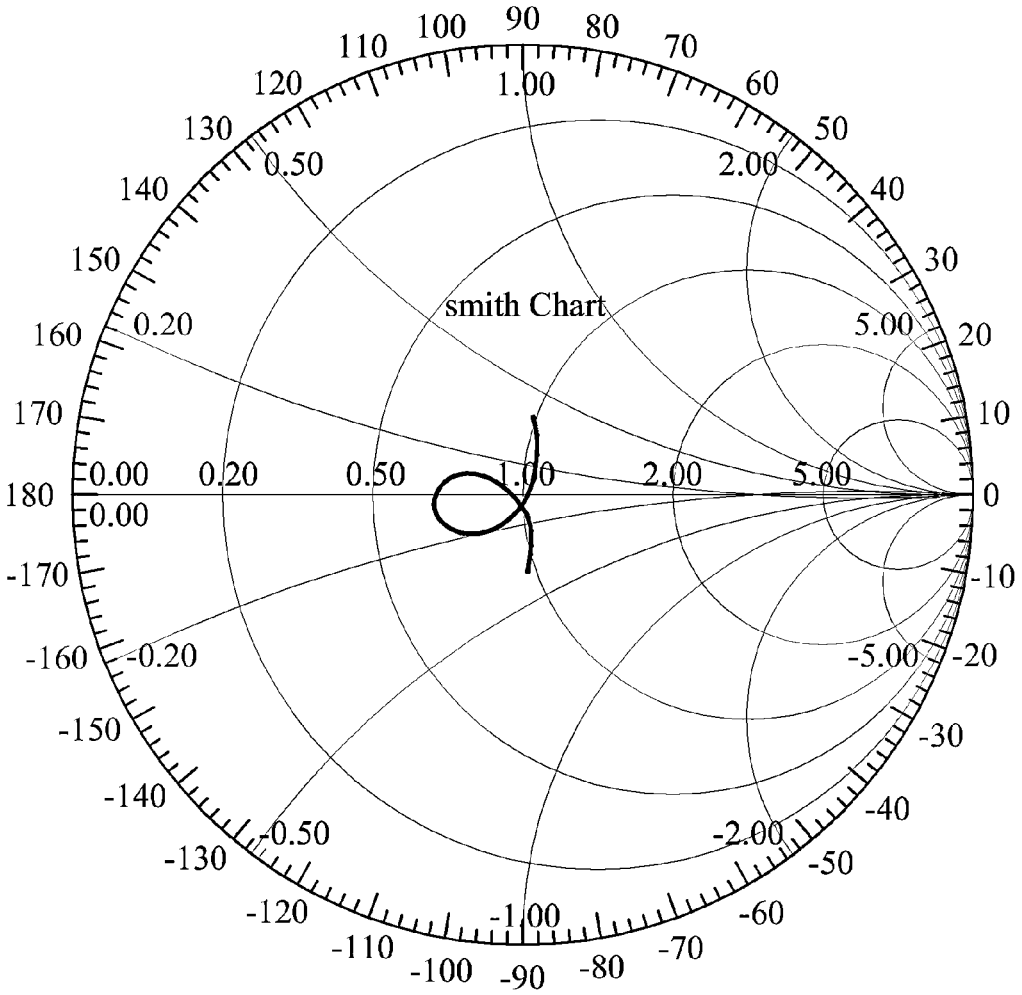
Figure 5D:
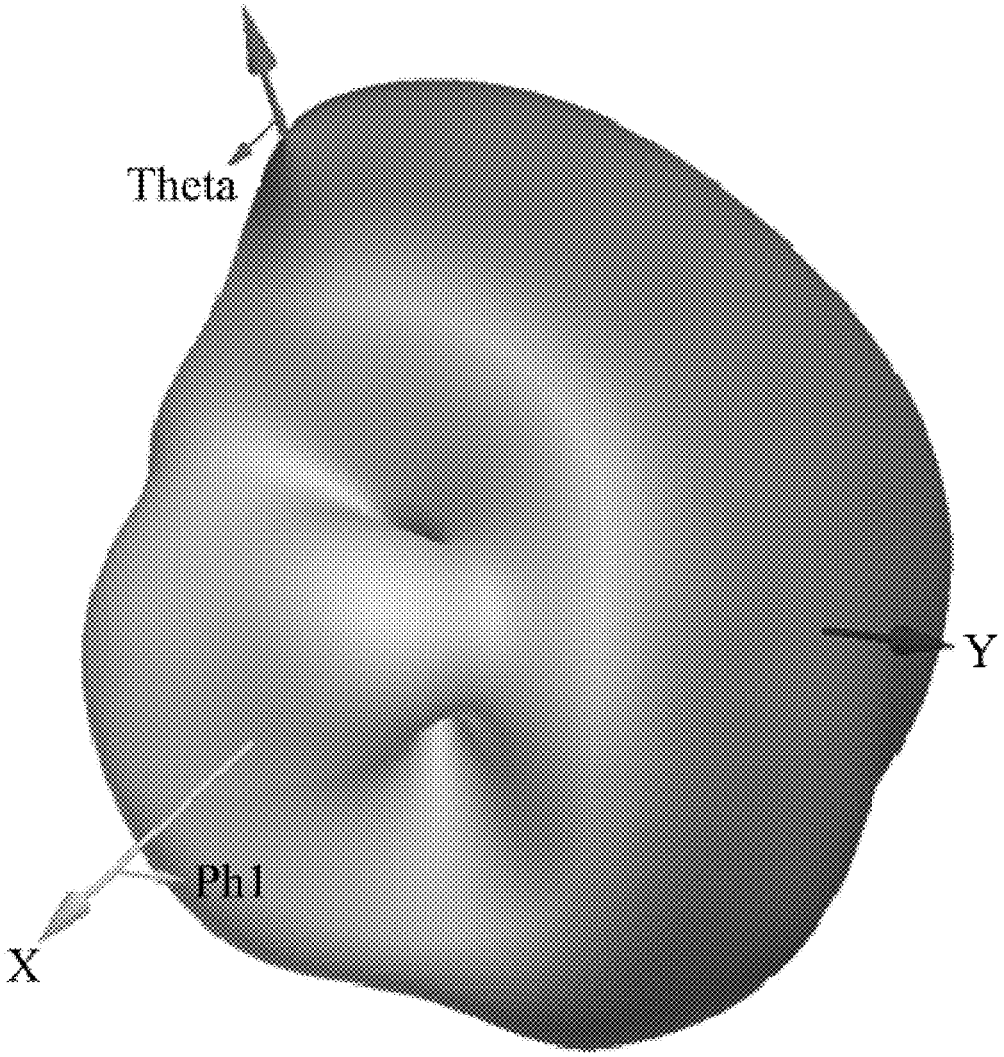

FIG. 5A shows a general type of a chamfered outer coaxial arc-shape leaky-wave antenna. FIG. 5B shows frequency dependency of a reflection coefficient $S_{11}$, that is, the reflection coefficient $S_{11}$ at about 5 to 7 GHz. FIG. 5C shows a Smith chart for the reflection coefficient $S_{11}$. FIG. 5D shows a 3D far-field radiation pattern when the leaky-wave antenna is used.

The processes, functions, and methods described above can be written as a computer program, a piece of code, an instruction, or some combination thereof, for independently or collectively instructing or configuring the processing device to operate as desired. Software and data may be embodied permanently or temporarily in any type of machine, component, physical or virtual equipment, computer storage medium or device that is capable of providing instructions or data to or being interpreted by the processing device. The software also may be distributed over network coupled computer systems so that the software is stored and executed in a distributed fashion. In particular, the software and data may be stored by one or more non-transitory computer readable recording mediums. The non-transitory computer readable recording medium may include any data storage device that can store data that can be thereafter read by a computer system or processing device. Examples of the non-transitory computer readable recording medium include read-only memory (ROM), random-access memory (RAM), Compact Disc Read-only Memory (CD-ROMs), magnetic tapes, USBs, floppy disks, hard disks, optical recording media (e.g., CD-ROMs, or DVDs), and PC interfaces (e.g., PCI, PCI-express, WiFi, etc.). In addition, functional programs, codes, and code segments for accomplishing the example disclosed herein can be construed by programmers skilled in the art based on the flow diagrams and block diagrams of the figures and their corresponding descriptions as provided herein.

The apparatuses and units described herein may be implemented using hardware components. The hardware components may include, for example, controllers, sensors, processors, generators, drivers, and other equivalent electronic components. The hardware components may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The hardware components may run an operating system (OS) and one or more software applications that run on the OS. The hardware components also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a hardware component may include multiple processors or a processor and a controller. In addition, different processing configurations are possible, such a parallel processors.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A leaky-wave antenna for a hearing device, the leaky-wave antenna comprising:

a coaxial radiator configured to receive audio signals from an external device and to indicate conductivity; and a grounding area provided in the coaxial radiator, wherein the leaky-wave antenna is connected to a housing of the hearing device.

2. The leaky-wave antenna of claim 1, wherein the coaxial radiator is helical.

3. The leaky-wave antenna of claim 1, wherein the coaxial radiator comprises a helical slit configured to propagate electromagnetic (EM) waves.

4. The leaky-wave antenna of claim 1, wherein the coaxial radiator comprises a plurality of conductive tubes.

5. The leaky-wave antenna of claim 4, wherein the plurality of conductive tubes have varying diameters.

6. The leaky-wave antenna of claim 1, further comprising:

two wires separate from each other and disposed in the grounding area, wherein the wires are configured to route the audio signals.

7. The leaky-wave antenna of claim 1, further comprising:

a wire disposed in the grounding area, wherein the wire is configured to route the audio signals.

8. The leaky-wave antenna of claim 1, further comprising:

a sound induction channel disposed in the grounding area, wherein the sound induction channel is configured to route audio signals generated from a loud speaker built in the hearing device.

9. The leaky-wave antenna of claim 1, wherein the audio signals are generated in accordance with a ultra wideband (UWB) standard.

10. The leaky-wave antenna of claim 8, wherein the loud speaker is configured to generate acoustic audio signals corresponding to the audio signals received through the coaxial radiator.

11. The leaky-wave antenna of claim 1, wherein the grounding area is a conductive cylindrical shell.

12. The leaky-wave antenna of claim 4, wherein the plurality of conductive tubes have varying lengths.

13. A hearing device comprising:

a housing; and a leaky-wave antenna connected to the housing, wherein the leaky-wave antenna comprises:

a coaxial radiator configured to receive audio signals from an outside of the hearing device and to indicate conductivity; and a grounding area provided in the coaxial radiator.

14. The hearing device of claim 13, wherein the coaxial radiator is helical.

15. The hearing device of claim 13, further comprising:

a helical slit to propagate electromagnetic (EM) waves.

16. The hearing device of claim 13, wherein the coaxial radiator comprises a plurality of conductive tubes.

17. The hearing device of claim 16, wherein the plurality of conductive tubes have varying diameters.

18. The hearing device of claim 13, wherein the audio signals are generated in accordance with an ultra wideband (UWB) standard.

19. A leaky-wave antenna for a hearing device comprising:

a coaxial radiator configured to receive audio signals from an external device; and a conductive core disposed in the coaxial radiator, wherein the conductive core is configured to provide grounding and to route the audio signals.

20. The leaky-wave antenna of claim 19, wherein the conductive core comprises:

a conductive cylindrical shell;

two wires disposed in a dielectric within the cylindrical shell.

21. The leaky-wave antenna of claim 20, wherein the wires are configured to route the audio signals.

22. The leaky-wave antenna of claim 20, wherein a first wire is configured to route the audio signals and a second wire is configured to provide grounding.

23. The leaky-wave antenna of claim 19, further comprising a loud speaker configured to generate acoustic audio signals corresponding to the audio signals, wherein the conductive core comprises a sound induction channel configured to route the generated audio signals.

24. The leaky-wave antenna of claim 19, wherein the coaxial radiator is disposed in a protective dielectric.

* * * * *